US006904892B1

(12) United States Patent
Afjeh et al.

(10) Patent No.: US 6,904,892 B1
(45) Date of Patent: Jun. 14, 2005

(54) COMPRESSION RELEASE BRAKE SYSTEM

(75) Inventors: Homa Afjeh, Peoria, IL (US); Mark S. Ellison, Pontiac, IL (US); John S. Pipis, Washington, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/739,489

(22) Filed: Dec. 18, 2003

(51) Int. Cl.[7] ..... F02B 33/00
(52) U.S. Cl. ..... 123/320; 123/321
(58) Field of Search ..... 123/319, 320, 123/321, 322

(56) References Cited

U.S. PATENT DOCUMENTS 5,537,976 A * 7/1996 Hu ..... 123/322
5,996,550 A 12/1999 Israel et al.
6,012,424 A * 1/2000 Meistrick ..... 123/321
6,082,328 A * 7/2000 Meistrick et al. ..... 123/321
6,095,115 A * 8/2000 Fuchs ..... 123/321
6,192,841 B1 2/2001 Vorih et al.
6,321,701 B1 * 11/2001 Vorih et al. ..... 123/90.12
6,334,429 B1 * 1/2002 Little, Jr. ..... 123/320
6,394,067 B1 * 5/2002 Usko et al. ..... 123/321
6,415,752 B1 7/2002 Janak
6,422,186 B1 * 7/2002 Vanderpoel ..... 123/90.15
6,694,933 B1 * 2/2004 Lester ..... 123/90.12

* cited by examiner

*Primary Examiner*—John T. Kwon
(74) *Attorney, Agent, or Firm*—Steve Noe

(57) ABSTRACT

A compression release brake system 10 includes a hydraulic apparatus 12 for controllably opening at least one exhaust valve 14 of at least one cylinder 16 of an engine in response to motion of a cam actuator 12. The system 10 includes a master piston assembly 40 having a master piston 42 engageable with the cam actuator 12. The master piston 42 includes a compressible piston pin 56. A slave piston assembly 44 is hydraulically linked to the master piston assembly 40 and includes a slave piston 46 engageable with the at least one exhaust valve 14.

7 Claims, 3 Drawing Sheets

COMPRESSION RELEASE BRAKE SYSTEM

TECHNICAL FIELD

The present invention relates generally to a system and method for opening at least one valve associated with a cylinder of an engine and, more particularly, to a system and method for controllably limiting the amount of lift or displacement of an engine valve during a valve opening event.

BACKGROUND

Engines, such as internal combustion engines, commonly utilize intake and exhaust valves associated with engine cylinders. In a normal running mode, intake valves may be opened to admit a fuel and air mixture into the combustion chamber of a cylinder, and exhaust valves may be opened to permit combustion byproducts to be exhausted from the cylinder.

It is also known to operate engines in a compression release braking mode, in which one or more engine cylinders are temporarily used to consume energy by compressing air. The energy required to compress air in the one or more engine cylinders produces a braking effect. This is accomplished by controllably opening a cylinder valve, for example, an exhaust valve, at a time when the engine has consumed energy compressing air in the cylinder, thus preventing recovery of the expended energy.

One common method for controllably opening an engine valve during a braking event is to use a rotating cam, for example, an injector cam, associated with the engine to provide the mechanical energy necessary to open the valve. The cam may be linked to the valve by a hydro/mechanical linkage including master and slave pistons and cylinders, such that rotation of the cam is translated into valve motion. One problem with this method is that the profile of the engine cam may not provide the optimum amount of valve displacement or lift. This is a particular problem in the braking mode of engine operation, because the engine cylinder valve is typically opened during the time that the cylinder piston is at or near top dead center. Consequently, if the valve extends too far into the cylinder it can make contact with the piston causing damage to the engine.

One approach to controlling the amount of valve displacement when using a fixed cam profile to indirectly actuate an engine valve is to employ some form of lost-motion linkage between the cam actuator and the engine valve. Such a linkage is designed to absorb motion caused by the fixed cam profile that exceeds the amount necessary to provide a desired valve displacement.

Many of the lost-motion devices employed in the past for this purpose incorporate some form of hydraulic arrangement, such that the force transmitted from the cam actuator to the engine valve is dissipated or absorbed hydraulically during at least a portion of the cam profile excursion. Such devices are sometimes referred to as hydraulic clippers, because they clip or limit excessive valve travel. For example, U.S. Pat. No. 6,415,752 illustrates a lost-motion system that includes a hydraulic accumulator that controllably absorbs hydraulic fluid in excess of that required to cause a desired engine valve displacement.

Known lost-motion devices used for the above described purpose tend to be complex and expensive, and often employ special and precise hydraulic fluid porting. This can lead to system failures and unreliable operation. The present invention is directed to overcoming one or more of the problems as set forth above.

SUMMARY OF THE INVENTION

In one aspect of the present invention, a compression release brake system includes a hydraulic apparatus for controllably opening at least one exhaust valve of at least one cylinder of an engine in response to motion of a cam actuator. The system includes a master piston assembly having a master piston engageable with the cam actuator. The master piston includes a compressible piston pin. A slave piston assembly is hydraulically linked to the master piston assembly and includes a slave piston engageable with the at least one exhaust valve.

In a second aspect of the present invention, a method for limiting travel of at least one exhaust valve of at least one cylinder of an engine during a compression release brake event is disclosed. The engine may include a cam actuator and a master piston assembly having a master piston. The master piston includes a compressible piston pin that is engageable with the cam actuator. A slave piston assembly is hydraulically linked to the master piston assembly and has a slave piston engageable with the at least one exhaust valve. A travel-limiting piston assembly has a travel-limiting piston positioned to controllably limit movement of the master piston. The method includes the steps of moving the travel-limiting piston to a position sufficient to limit movement of the master piston to a predetermined amount. The master piston is moved the predetermined amount in response to the cam actuator, and the at least one exhaust valve is responsively opened a predetermined amount. The compressible piston pin is compressed in response to further action of the cam actuator beyond that required to move the master piston the predetermined distance.

DETAILED DESCRIPTION

Figure 1:
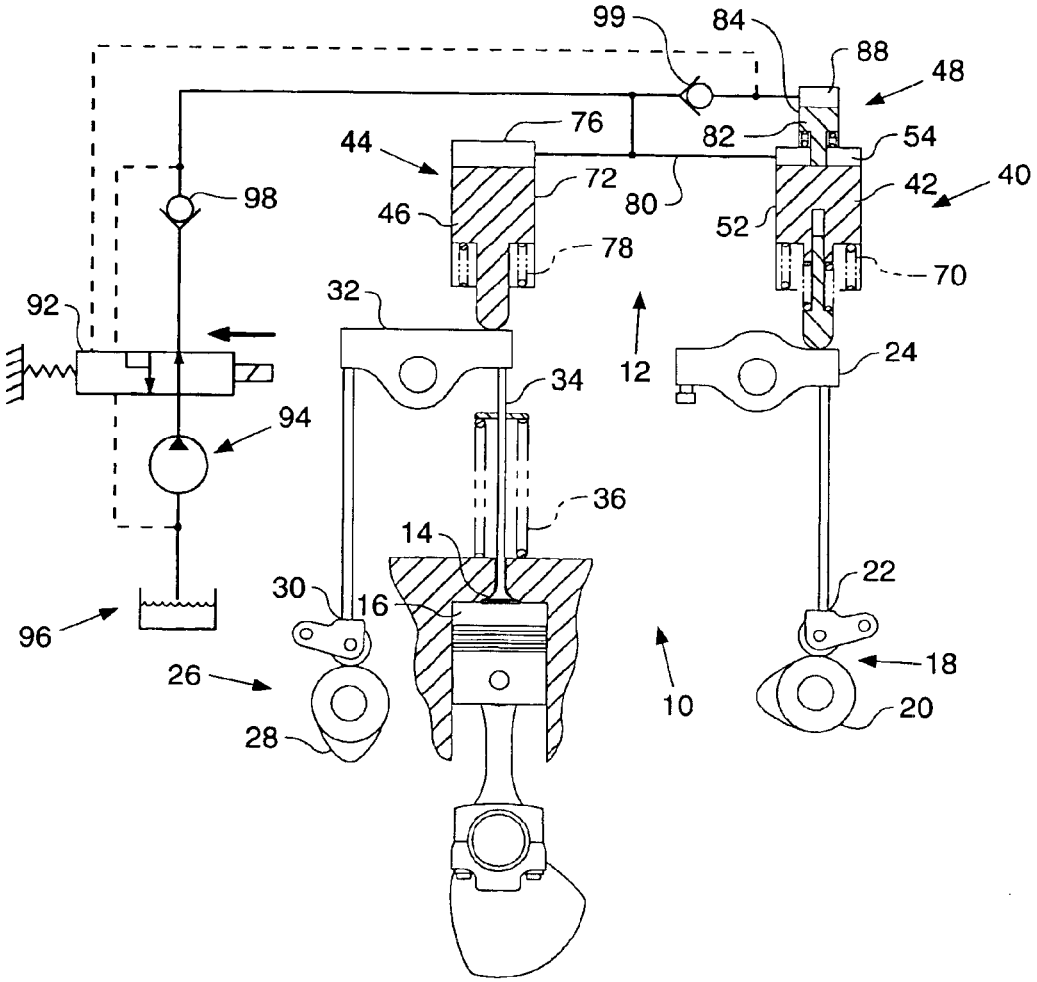
FIG. 1 is a schematic representation of an embodiment of the present invention configured for compression release braking operation.
Figure 2:
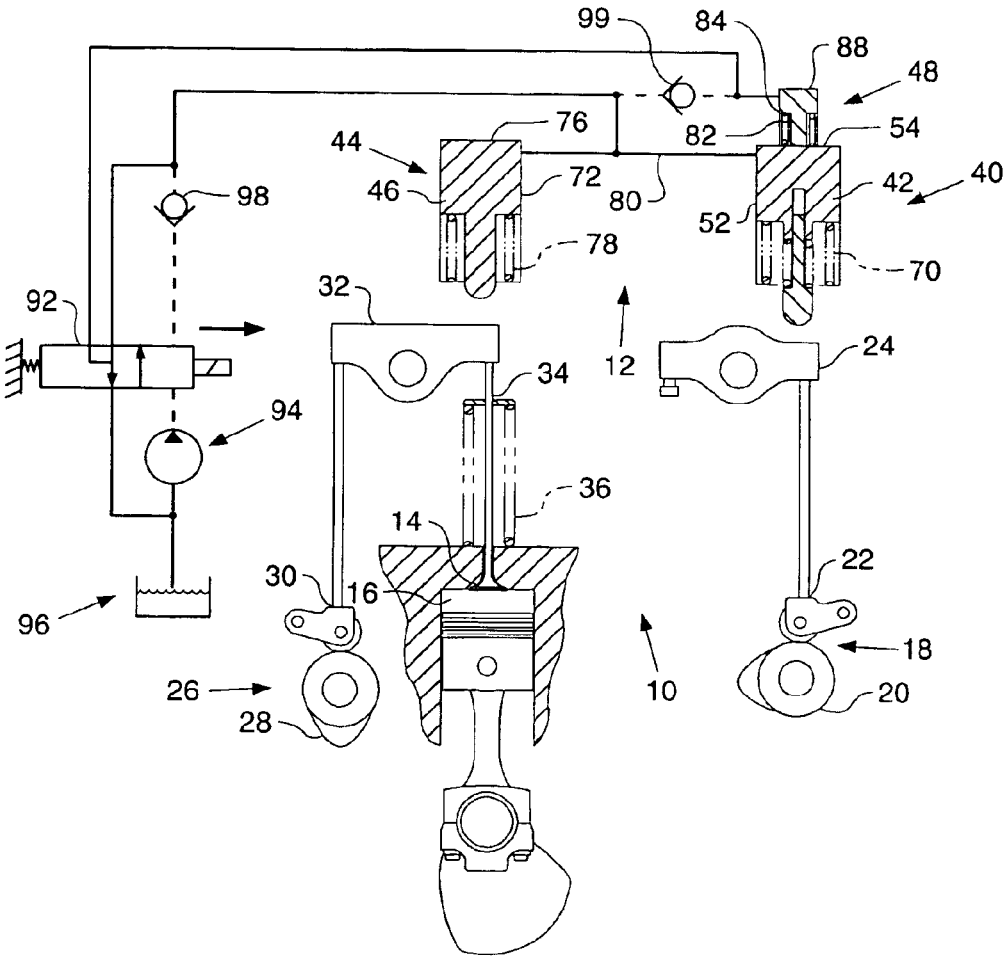
FIG. 2 is a schematic representation of an embodiment of the present invention configured for powered operation.

Referring first to FIGS. 1 and 2, a compression release brake system 10 includes a hydraulic apparatus 12 for controllably opening at least one exhaust valve 14 of at least one cylinder 16 of an engine (not shown) in response to motion of a cam actuator 18. The cam actuator 18 may be a rotating cam such as an injector cam 20 that is normally used to activate one or more fuel injectors, and may include a cam follower 22 and rocker arm arm 24 arranged to translate the rotary motion of the cam 20 into a linear driving motion, as is well known in the engine art. The engine valve 14 may include a similar cam driver 26 having an associated cam 28, cam follower 30, and rocker arm 32. The rocker arm 32 normally reciprocates according to the profile of the cam 28, in turn periodically opening the engine valve 14 by transferring motion to a push rod 34. A valve closing spring 36 acts to close the engine valve 14 when it is not held open by the rocker arm 32.

A master piston assembly 40 has a master piston 42 engageable with the cam actuator 18 through the cam follower 22 and rocker arm 24 arrangement. A slave piston assembly 44 is hydraulically coupled to the master piston assembly 40 and includes a slave piston 46 engageable with the at least one exhaust valve 14 through the associated rocker arm 32 and push rod 34. A travel-limiting piston assembly 48 is positioned relative to the master piston assembly 40 to controllably limit linear movement of the master piston 42 within the master piston assembly 40 to a predetermined amount.

Figure 3:
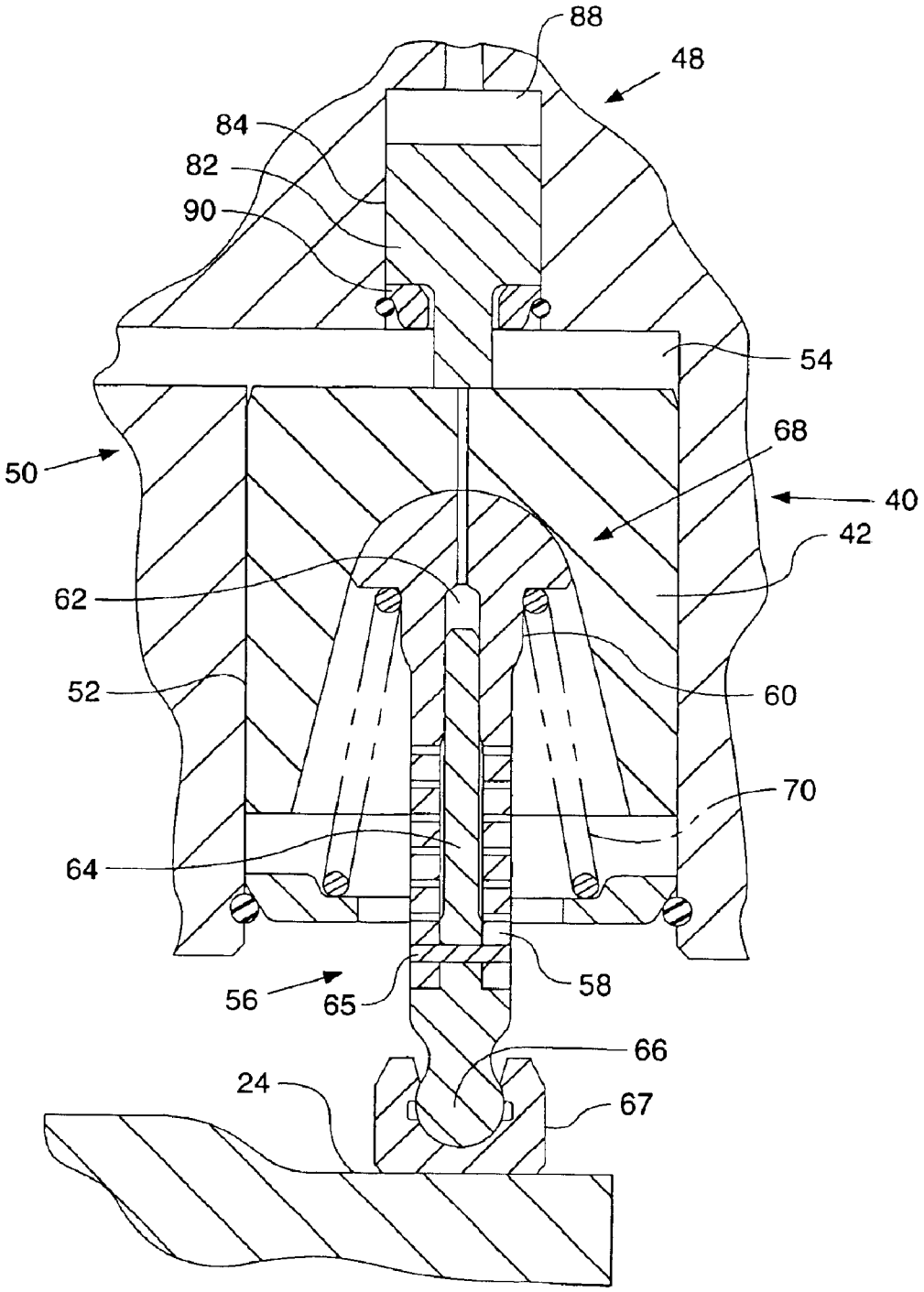
FIG. 3 is a cross-section of a travel-limiting master piston assembly in accordance with an embodiment of the present invention.

The master, slave, and travel-limiting piston assemblies 40, 44, 48 are shown in more detail in FIG. 3. The master piston assembly 40 includes a piston housing 50 having a bore 52. The master piston 42 is slidably disposed in the piston housing bore 52 and cooperates with the piston housing 50 to form a master hydraulic reservoir 54. In the illustrated embodiment, a compressible piston pin 56 has a compressible portion 58, a solid portion 60, and a bore 62 extending through the compressible portion 58 into the solid portion 60. A guide pin 64 is slidably disposed in the piston pin bore 62, and has an end portion 66 engageable with the rocker arm 24 of the cam actuator 18. The end portion 66 may be connected to an end of the master pin compressible portion 58 with a shear pin 65, and may include a swivelable foot 67 adapted to maintain alignment between the guide pin 64 and the rocker arm 24. The guide pin 64 is adapted to controllably move the master piston 42 within the piston housing bore 52 in response to motion of the cam actuator 18. The master piston 42 also may include a pin receiving portion 68, and a piston spring 70 arranged between the piston housing 50 and the piston pin solid portion 60. The piston spring 70 is arranged to urge the piston pin solid portion 60 into abutting arrangement with the master piston pin receiving portion 68, and to further urge the master piston 42 in the direction of the master hydraulic reservoir 54.

The slave piston 46 of the slave piston assembly 44 is slidably disposed in a slave piston housing bore 72 to form a slave hydraulic reservoir 76. A slave piston spring 78 is arranged to urge the slave piston 46 in the direction of the slave hydraulic reservoir 76. The master and slave hydraulic reservoirs 54, 76 are connected to one another by a hydraulic line 80.

The travel-limiting piston assembly 48 includes a travel-limiting piston 82 that is slidably disposed in a travel-limiting piston housing bore 84 to form a travel-limiting hydraulic reservoir 88. The travel-limiting piston assembly 48 may be mounted integral with the master piston assembly 40, and the end of the travel-limiting piston 82 opposite the travel-limiting hydraulic reservoir 88 may controllably extend a predetermined distance into the master hydraulic reservoir 54 in a manner sufficient to contact the master piston 22. The predetermined distance may be established by a travel-limiting piston stop 90 as shown. This distance may be made adjustable by, for example, providing means for adjusting this stop or for moving the travel-limiting piston assembly 48 relative to the master piston assembly 40.

A brake control valve 92 is controllably connectable to a pressurized hydraulic fluid supply 94, a hydraulic fluid drain 96, and to each of the master, slave, and travel-limiting hydraulic reservoirs 54, 76, 88. The brake control valve 92 is movable between a power position as shown in FIG. 2, at which the master, slave, and travel-limiting piston reservoirs 54, 76, 88 are connected through the brake control valve 92 to the hydraulic fluid drain 96, and a brake position, as shown in FIG. 1, at which the master and slave hydraulic reservoirs 54,76 are connected to the hydraulic fluid supply 94 through a first check valve 98, and the travel-limiting hydraulic reservoir 88 is connected to the hydraulic fluid supply 94 through the first check valve 98 and through a second check valve 99.

In a preferred embodiment, the compressible piston pin 56 compressible portion 58 may be implemented as a machined helical spring. Such machined springs are commercially available from Helical Products Company, Inc. However, other structural arrangements that result in a compressible piston pin may be substituted for the preferred machined spring without deviating from the scope of the present invention. For example, the piston pin 56 could be implemented in two or more discreet pieces incorporating a solid portion with a more conventional coil spring. It is also foreseeable that the solid portion could be dispensed with and the entire compressible pin could be implemented in the form of a machined or coil spring. Thus, it is intended that the present invention be construed to cover these and other modifications that come within the scope of the appended claims and their legal equivalents.

INDUSTRIAL APPLICABILITY

During powered operation of an engine incorporating the present invention, the brake control valve 92 is electrically shifted to the power position described in FIG. 2. In this mode, the hydraulic reservoirs 54, 76, 88 of the master piston assembly 40, the slave piston assembly 44, and the travel-limiting piston assembly 48 arc all connected through the control valve 92 to the hydraulic fluid drain or sump 96. Consequently, the master and slave return springs 70, 78 associated with the respective piston assemblies 40, 44 force the respective pistons 42, 46 to retract, and the master and slave pistons 42, 46 are removed from engagement with the cam actuator 18 and exhaust valve 14, respectively.

The master piston spring 70 and master piston 42 also act on the travel-limiting piston 82 causing it to reset to a retracted position. Hydraulic fluid in the master, slave, and travel-limiting hydraulic reservoirs 54, 76, 88 is returned through the control valve 92 to the hydraulic fluid drain 96. Consequently, the exhaust valve 14 is not influenced by the hydraulic apparatus 12 and the engine operates in a conventional manner.

During braking operation of the engine, the control valve 92 is shifted to the braking position as depicted in FIG. 1. Hydraulic fluid is supplied under pressure from the hydraulic fluid supply 94 through the check valves 98, 99 to the master hydraulic reservoir 54, the slave hydraulic reservoir 76, and the travel-limiting hydraulic reservoir 88. In turn, the master piston 42, compressible piston pin 56, and guide pin 64 are engaged through the rocker arm 24 and cam follower 22 with the cam 20 of the cam actuator 18. Likewise, the slave piston 46 is engaged with the exhaust valve 14 through the rocker arm 32 and push rod linkage 34. Finally, the travel-limiting piston 82 is extended to its predetermined position and is hydraulically locked by the second check valve 99. With the hydraulic reservoirs 54, 76, 88 filled and hydraulically locked by the check valves 98, 99, the guide pin 64 and responsively the compressible piston pin 56 and master piston 42 will attempt to follow the motion induced by rotation of the cam actuator 18.

As the master piston 42 moves upward in the piston housing bore 52, hydraulic fluid in the master hydraulic reservoir 54 is displaced through the hydraulic line 80 to the slave hydraulic reservoir 76. This forces the slave piston 46 to extend and the exhaust valve 14 to open. However, once the master piston 42 makes contact with the travel-limiting piston 82, further linear movement of the master piston 42 within the piston housing bore 52 is blocked and further extension of the slave piston 46 cannot occur. Consequently, the amount of exhaust valve 14 displacement or lift is limited in accordance with the preset travel-limiting piston assembly 48.

However, the cam actuator 18 continues to exert upward force on the guide pin 64 and the compressible piston pin 56, causing the piston pin compressible portion 58 to compress. The guide pin 64 is free to continue to move within the piston pin bore 62 as compression occurs, so the additional motion imparted by the cam actuator 18 is absorbed by the compressible piston pin 56. As the cam actuator 18 continues to revolve and the direction of linear motion is reversed, the piston pin compressible portion 58 again extends to follow the cam 20 profile. Once fully extended, continued rotation of the cam actuator 18 permits the exhaust valve closing spring 36 to close the exhaust valve 14, forcing hydraulic fluid out of the slave hydraulic reservoir 76 and back into the master hydraulic reservoir 54. The cycle continues until the control valve 92 is returned to the engine power position depicted in FIG. 2.

The above described embodiments of the invention discuss a simple system for controllably actuating a single valve associated with one cylinder of an engine. However, the described system can be readily multiplied in a straightforward manner to include multiple valves in multiple engine cylinders, as would be typically employed for compression release braking without departing from the scope of the present invention. Likewise, other modifications of the described embodiment may be made by one skilled in the art without deviating from the scope of the appended claims and legal equivalents.

What is claimed is:

1. A compression release brake system having a hydraulic apparatus for controllably opening at least one exhaust valve of at least one cylinder of an engine in response to motion of a cam actuator, comprising:

a master piston assembly having a master piston engageable with said cam actuator, said master piston including a compressible piston pin; and a slave piston assembly hydraulically linked to said master piston assembly and having a slave piston engageable with said at least one exhaust valve.

2. A compression release brake system, as set forth in claim 1, including a travel-limiting piston assembly positioned to controllably limit linear movement of said master piston within said master piston assembly to a predetermined amount.

3. A compression release brake system, as set forth in claim 2, wherein said compressible piston pin is adapted to absorb motion induced by said cam actuator which exceeds that necessary to move said master piston said predetermined amount.

4. A compression release brake system, as set forth in claim 3, including a brake control valve controllably connectable to a hydraulic fluid supply, a hydraulic fluid drain, and to each of said master, slave, and travel-limiting piston assemblies, said brake control valve being moveable between a power position at which said master, slave, and travel-limiting piston assemblies are connected to said hydraulic fluid drain, and a brake position at which said master, slave, and travel-limiting piston assemblies are connected to said hydraulic fluid supply.

5. A compression release brake system, as set forth in claim 3, wherein said master piston assembly includes:

a piston housing having a bore, said master piston being slidably disposed in said piston housing bore;

said compressible piston pin having a compressible portion, a solid portion, and a bore extending through said compressible portion into said solid portion; and a guide pin slidably disposed in said piston pin bore and having an end portion engageable with said cam actuator and being adapted to controllably move said master piston within said piston housing bore in response to motion of said cam actuator.

6. A compression release brake system, as set forth in claim 5, wherein said master piston includes a pin receiving portion, and said master piston assembly further includes a piston spring arranged between said piston housing and said piston pin solid portion and adapted to urge said piston pin solid portion into abutting arrangement with said piston body pin receiving portion.

7. A method for limiting travel of at least one exhaust valve of at least one cylinder of an engine during a compression release brake event, said engine having a cam actuator, a master piston assembly having a master piston, said master piston including a compressible piston pin and a guide pin, said guide pin being engageable with said cam actuator, a slave piston assembly hydraulically linked to said master piston assembly and having a slave piston engageable with said at least one exhaust valve, and a travel-limiting piston assembly having a travel-limiting piston positioned to controllably limit movement of said master piston, comprising the steps of:

moving said travel-limiting piston to a position sufficient to limit movement of said master piston to a predetermined amount;

moving said master piston said predetermined amount in response to said cam actuator acting upon said guide pin, and responsively opening said at least one exhaust valve a predetermined amount; and compressing said compressible piston pin in response to further action of said cam actuator upon said guide pin beyond that required to move said master piston said predetermined distance.

* * * * *